US006494057B1

(12) United States Patent
Schuster et al.

(10) Patent No.: US 6,494,057 B1
(45) Date of Patent: Dec. 17, 2002

(54) COMBINATION ACCUMULATOR FILTER DRIER

(75) Inventors: Don A. Schuster, Martinsville, IN (US); Larry D. Burns, Avon, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/621,288

(22) Filed: Jul. 20, 2000

(51) Int. Cl.[7] ..... F25B 43/00
(52) U.S. Cl. ..... 62/475; 62/503; 62/474
(58) Field of Search ..... 62/503, 474, 475

(56) References Cited

U.S. PATENT DOCUMENTS 5,914,456 A * 6/1999 LeConey et al. ..... 96/121
5,937,670 A * 8/1999 Derryberry ..... 62/324.4
5,966,810 A * 10/1999 Chisnell et al. ..... 29/890.06
5,970,738 A * 10/1999 DeNolf et al. ..... 62/474
5,992,160 A * 11/1999 Bussjager et al. ..... 62/79
5,996,371 A * 12/1999 Riemenschneider ..... 62/474
6,038,881 A * 3/2000 Murray ..... 62/474
6,083,305 A * 7/2000 LeConey et al. ..... 96/147
6,167,720 B1 * 1/2001 Chisnell ..... 62/474
6,209,347 B1 * 4/2001 Corrigan et al. ..... 62/475
6,223,555 B1 * 5/2001 Schroeder et al. ..... 62/503

* cited by examiner

*Primary Examiner*—William C. Doerrler
*Assistant Examiner*—Mark S. Shulman
(74) *Attorney, Agent, or Firm*—Wall Marjama & Bilinski LLP

(57) ABSTRACT

The invention is directed to an accumulator device which has an outer housing having an inlet and an outlet, and a U tube contained within the housing. The device also includes a filter which is positioned inside the housing adjacent the inlet. Dryer means in the form of a desiccant are also contained inside the housing. The device is positioned upstream of a compressor and functions to filter unwanted debris which would otherwise enter the compressor and cause potential damage.

8 Claims, 2 Drawing Sheets

COMBINATION ACCUMULATOR FILTER DRIER

BACKGROUND OF THE INVENTION

The invention relates generally to air conditioning and heat pump systems, and more specifically to an improved accumulator device which is designed to also carry out a filtering and drying function.

A suction accumulator is usually positioned between an evaporator and the compressor in a heat pump or air conditioner. During operation, the suction accumulator receives the combined liquid and vapor from the evaporator via an inlet baffle. Vapor passes on to the compressor via an outlet tube and a metered amount of oil and liquid refrigerant mixture is passed through an orifice to the compressor. When the heat pump or air conditioner is off for an extended period, the refrigerant tends to liquefy within the low side of the system. When the system is turned on, or at low ambient operating conditions, large amounts of liquid refrigerant can return to the compressor. Liquid surges can damage the compressor if the accumulator is not present. The accumulator prevents such liquid surges.

In normal operation, the filter dryer in an air conditioning system is positioned in the liquid line which does not insure that the compressor is protected by debris which enters the system from the line set or door coil. It is only in high risk situations, such as where a compressor has failed, is the filter dryer placed in the suction line of the compressor.

The debris which can pass into the system and through the compressor is from the result of lubricant breakdown, and from slag from solder, oxidized copper from brazing and debris left over from the manufacturing processes and field fabricated tubing. It can therefore be seen that there is a need for a system which can effectively filter out debris prior to it entering the compressor.

SUMMARY OF THE INVENTION

It is therefore an object of the present invention to provide an improved accumulator design which overcomes the problems of the prior art described above.

It is another object of the present invention to provide a more efficient accumulator which accomplishes a plurality of functions.

It is yet another object of the present invention to provide an accumulator design which eliminates the need for a separate filter dryer in air conditioning, heat pump or refrigeration systems using rotary compressors.

It is a further object of the present invention to provide an accumulator which exhibits improved filtering.

The present invention is directed to an improved accumulator which includes a filter component and a dryer component. The combination of a filter member and a dryer member eliminates the requirement for a separate filter and dryer in the system. As will be described in greater detail hereinafter, the filter component is positioned immediately below the accumulator inlet, and functions to catch all debris entering the system. The dryer component contains a desiccant contained in a porous outer covering or bag, and functions to remove moisture from the refrigerant thus preventing detrimental reactions. This design reduces the system components by combining various functions into one component-the accumulator.

DETAILED DESCRIPTION OF THE INVENTION

Figure 1:
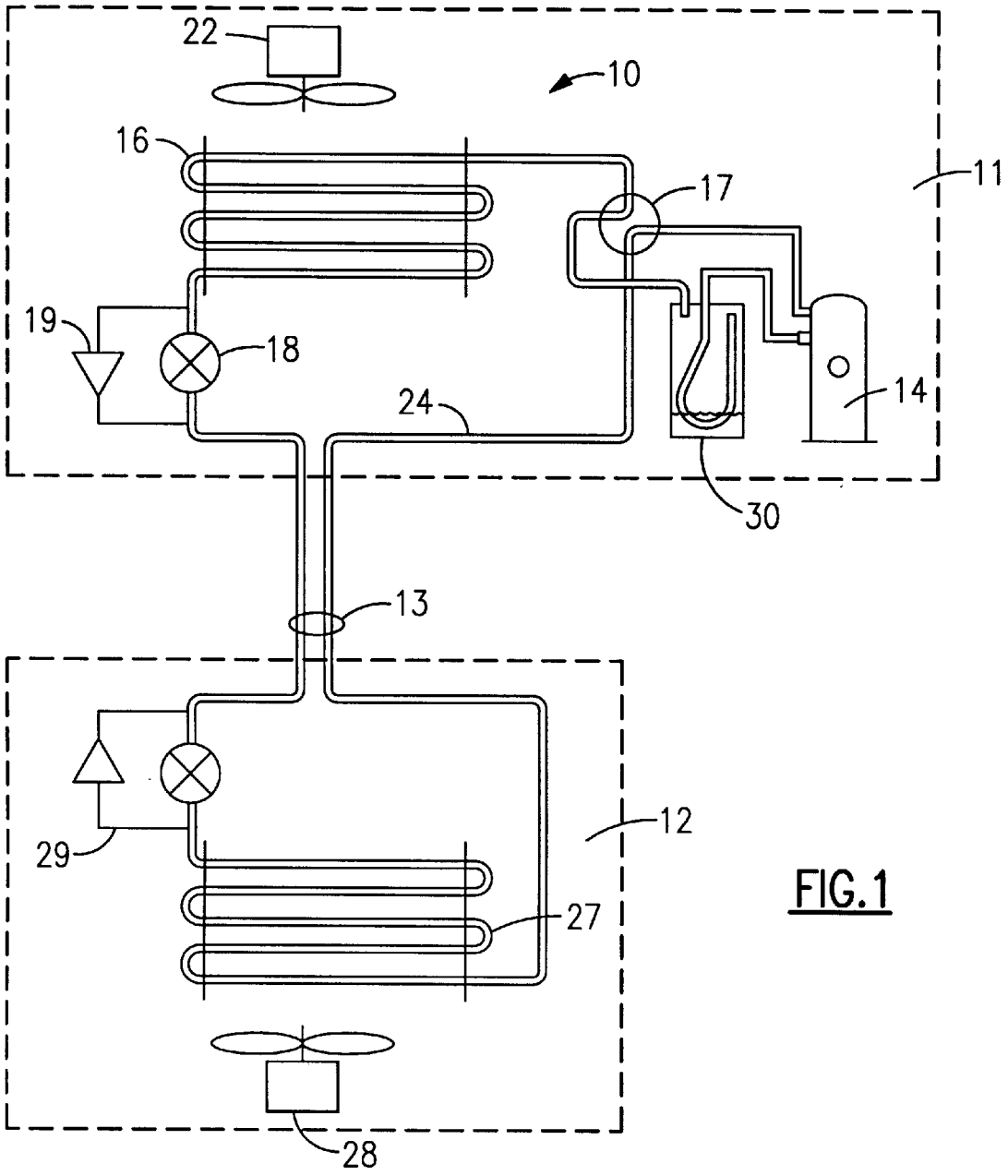
FIG. 1 is a schematic illustration of a heat pump with the present invention incorporated therein.

Referring now to FIG. 1, the invention is shown generally at 10 as applied to a conventional heat pump system having an outdoor unit 11 and an indoor unit 12 interconnected by tubing commonly referred to as a line set 13. Application in an air conditioner type system is similar The outdoor unit 11 includes a compressor 14 and a heat exchanger coil 16 which operate in a conventional manner in cooperation with the indoor unit 12 to bring about a complete refrigeration cycle while operating in either the heating or cooling mode. That is, the outdoor coil 16 acts as a condenser coil when the system is operating in the cooling mode and as an evaporator during periods when the system is operating in the heating mode. A four way valve 17 is included in the outdoor section 11 to switch between the heating and cooling modes in a conventional manner. Also, an expansion device 18 is provided for use during heat pump modes of operation, with a bypass line 19 acting to bypass the expansion device 18 during periods of air conditioning modes of operation. An accumulator 30 is provided at the evaporator outlet to prevent liquid refrigerant from returning to the compressor 14. An outdoor fan 22 is provided to circulate outdoor air over the outdoor coil 16 in conventional manner, except as modified by the present invention.

Referring now to the indoor unit 12, there is included an indoor heat exchanger coil 27 and an indoor fan 28 for circulating indoor air thereover. An expansion device 29, with a bypass portion, is included to accommodate the cooling and heating modes in a conventional manner.

Figure 2:
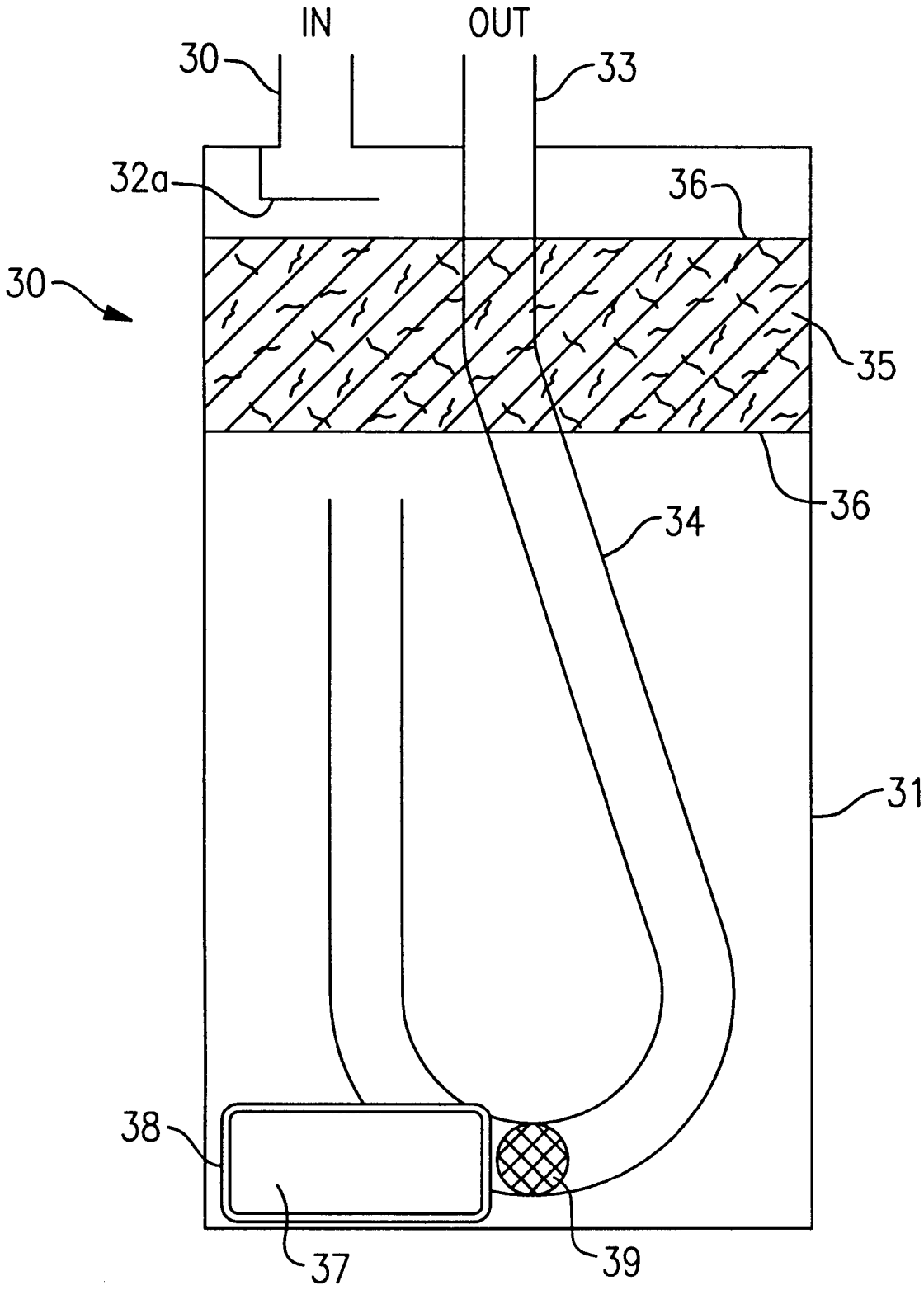
FIG. 2 is an enlarged view of the accumulator filter dryer of the present invention.

As shown in more detail in FIG. 2, the invention is directed to an improved accumulator filter dryer 30. The accumulator 30 contains an outer housing 31, an inlet 32 and outlet 33. A metal U tube 34 is connected at one end to outlet 33. An oil return orifice in the form of a screen 39 is included to prevent oil from being trapped in the accumulator. The screen is attached to the wide opening of a funnel (not shown), the small end of which is soldered in place in a hole in the U tube. The screen functions to prevent debris from plugging the hole in the U tube. The accumulator further contains a filter media 35 such as a fiberglass or felt just below the inlet deflector 32*a*. The filter media is preferably supported on a screen, perforated plate or wire mesh 36. The filter media functions to catch any debris as it enters the accumulator prior to it entering the compressor. The media also catches any debris that could possibly plug the oil return screen or orifice 39. The accumulator also contains a desiccant 37 sealed in a felt bag 38 which functions to remove moisture from the refrigerant.

The combination of the filter media and desiccant bag will eliminate the need for a separate filter dryer in the system. This will also be a more effective filtering device for the system. When the filter dryer is located in the liquid line in an air conditioning system, all debris entering the system from the line set or in door coil must pass through the compressor prior to the filter catching the debris. The method described herein will catch all debris from within the outdoor unit left over from the manufacturing processes. It will also catch all field installed debris.

It can be seen from the above, that the present invention functions to reduce system components by combining multiple functions into one component, minimize attrition problems with compressed bead filter dryers. As described above, the filter media has been positioned inside the accumulator, along with a desiccant bag.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. In a heat pump or air conditioner system having a compressor, outdoor and indoor fans, outdoor and indoor coils interconnected by liquid and vapor lines, said system further including an accumulator device positioned on line upstream of said compressor with said accumulator having an outer housing which contains an inlet and an outlet with filter means being positioned inside said housing adjacent said inlet.

2. The system as set forth in claim 1 wherein said accumulator device further contains a U tube within said housing with one end of said U tube being connected to said outlet.

3. The system as set forth in claim 1 wherein said accumulator device further contains dryer means contained within said accumulator housing.

4. The system as set forth in claim 3 in which the dryer means in the form of a desiccant contained in a porous bag.

5. An accumulator device suitable for use in a heat pump or air conditioner system which further contains a filter and dryer component, said device comprising:

(a) an outer housing which contains an inlet and an outlet;

(b) a U tube contained within said housing with one end of said U tube connected to said outlet; and wherein the improvement comprises a filter means positioned within said housing adjacent said inlet; and dryer means contained within said housing.

6. The device as set forth in claim 5 in which the filter means is supported on a screen perforated plate or wire mesh.

7. The device as set forth in claim 5 in which the dryer means is in the form of a desiccant.

8. In a heat pump or an air conditioner system having a compressor, outdoor and indoor fans, and outdoor and indoor coils interconnected by liquid and vapor lines said system further including an accumulator device positioned on-line upstream of said compressor with said accumulator having a deflector-inlet and wherein the improvement comprises a filter media positioned just below said deflector-inlet which functions to filter debris from all of the refrigerant entering said inlet-deflector, said accumulator further having a dryer positioned down-stream from said filter media for drying filtered liquid and vapor refrigerants exiting said filter media prior to entering said compressor.

* * * * *